US010328742B2

(12) United States Patent
Green et al.

(10) Patent No.: US 10,328,742 B2
(45) **Date of Patent: *Jun. 25, 2019**

(54) MARKER HOLDER AND ERASER

(71) Applicant: Chameleon Corporation, Inc., Franklin, TN (US)

(72) Inventors: Matthew D. Green, Franklin, TN (US); Alfred Darrel Shanbour, II, Brentwood, TN (US)

(73) Assignee: Chameleon Corporation, Inc., Franklin, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/230,531

(22) Filed: Aug. 8, 2016

(65) Prior Publication Data

US 2018/0009254 A1 Jan. 11, 2018

Related U.S. Application Data

(63) Continuation of application No. 14/572,630, filed on Dec. 16, 2014, now Pat. No. 9,409,437.

(60) Provisional application No. 62/083,398, filed on Nov. 24, 2014.

(51) Int. Cl.

| | |
|---|---|
| ***A47L 13/16*** | (2006.01) |
| ***A47L 25/00*** | (2006.01) |
| ***B43K 23/00*** | (2006.01) |
| ***B43K 23/06*** | (2006.01) |
| ***B43L 19/00*** | (2006.01) |
| ***B43L 21/00*** | (2006.01) |
| ***B43L 21/04*** | (2006.01) |
| ***B43L 19/04*** | (2006.01) |
| ***B43K 29/02*** | (2006.01) |

(52) U.S. Cl.

CPC ..... *B43K 23/001* (2013.01); *A47L 13/16* (2013.01); *A47L 25/00* (2013.01); *B43K 23/06* (2013.01); *B43K 29/02* (2013.01); *B43L 19/0056* (2013.01); *B43L 19/04* (2013.01); *B43L 21/00* (2013.01); *B43L 21/04* (2013.01)

(58) Field of Classification Search

CPC ..... A47L 13/16; A47L 25/00; B43K 23/001; B43K 23/06; B43L 19/0056; B43L 21/00; B43L 21/04

See application file for complete search history.

(56) References Cited

U.S. PATENT DOCUMENTS

| | | | |
|---|---|---|---|
| 2,862,626 | A | 12/1958 | Clare |
| 3,110,917 | A | 11/1963 | McPeek, Jr. |
| 4,543,680 | A | 10/1985 | Vlahos |
| 4,875,591 | A | 10/1989 | Mikesell |
| 5,232,103 | A | 8/1993 | Koenig et al. |
| 5,337,906 | A | 8/1994 | Digiulio |
| 5,432,973 | A | 7/1995 | Wagner |
| 5,544,764 | A | 8/1996 | Cima |
| 5,947,304 | A | 9/1999 | Thorp |
| 6,793,430 | B1 | 9/2004 | Liu |
| 6,948,874 | B2 | 9/2005 | Roberson |

(Continued)

*Primary Examiner* — Randall E Chin

(74) *Attorney, Agent, or Firm* — Michael L. Leetzow, P.A.

(57) ABSTRACT

A new design for a marker holder and eraser has a front side and a back side, the back side having a recess. The front side has two openings for retaining markers. A metal plate and a magnet holder are disposed within the recess and an erasing material covers the recess. Projections extend from the magnet holder into openings on the front side to engage markers disposed in the openings, thereby holding the markers at any angle.

13 Claims, 10 Drawing Sheets

(56) References Cited

U.S. PATENT DOCUMENTS

| | | | |
|---|---|---|---|
| 7,086,559 | B2 | 8/2006 | Poole, Jr. |
| 7,309,181 | B2 | 12/2007 | Hawkins |
| 8,032,966 | B1 | 10/2011 | Keller |
| D663,776 | S | 7/2012 | Lira-Nunez et al. |
| D669,937 | S | 10/2012 | Lira-Nunez et al. |

MARKER HOLDER AND ERASER

REFERENCE TO RELATED CASE

This application claims priority under 35 U.S.C. § 119(e) and 35 U.S.C. § 120 to provisional application No. 62/083,398, filed on Nov. 24, 2014, and U.S. Pat. No. 9,409,437, issued on Aug. 9, 2015, which are hereby incorporated by reference in their entirety.

BACKGROUND OF THE INVENTION

Field of the Invention

White boards have, for the most part, replaced chalk boards in the classroom and in board rooms. However, a functional yet attractive marker holder and eraser have lagged behind in accompanying the new boards. The marker holders should accommodate a number of markers and be within reach of the user. When there is no place on the board to store the makers, even if only temporarily, the markers are frequently misplaced or lost. Additionally, many of the marker holders are fixed in place and only provide one function: holding the markers, usually at the wrong end of the board. Thus, a holder that is movable, functional, attractive and serves more than one purpose is needed.

A new marker holder and eraser allows for the storage of multiple markers and provides an eraser at the same time. The marker holder and eraser can be moved around the white board, erases the markings on the white board, and holds the markers at any angle.

SUMMARY OF THE INVENTION

The present invention is directed to a marker holder and eraser that includes a main body having a front side and an opposite back side, the front side having two marker openings extending along a length thereof to receive a marker in each of the marker openings and the back side having a recess, a metal plate disposed within the recess on the back side of the main body, a magnet holder disposed within the recess on the back side of the main body, at least two magnets attached to the magnet holder, and erasing material disposed within the recess and covering at least a portion of the magnet holder, the erasing material capable of erasing marker ink on a dry-erase board.

In some embodiments, the the magnet holder has two resilient projections extending away from a front side of the magnet holder, the main body has two corresponding resilient projection openings, one resilient projection opening being disposed within one of each of the marker openings on the front side of the main body.

In other embodiments, marker openings on the front side are cylindrical cavities configured to receive a marker and the cylindrical cavities have a diameter, the diameter decreasing with increasing depth into the cavities.

In some embodiments, the magnet holder has at least two recesses, the at least two recesses each having a magnet therein.

In other embodiments, the main body has a top end and a bottom end, the marker openings being circular in cross section at the bottom end and semi-circular at the top end.

In yet another aspect, the present invention is directed to a marker holder and eraser that includes a main body having a front side and an opposite back side, the front side having two marker openings extending along a length thereof to receive a marker in each of the marker openings and the back side having a recess, a metal plate disposed within the recess on the back side of the main body, a magnet holder disposed within the recess on the back side of the main body, the magnet holder having at least two recesses, at least two magnets disposed in the recesses in the magnet holder; and erasing material disposed at least partially within the recess and covering at least a portion of the magnet holder, the erasing material capable of erasing marker ink on a dry-erase board.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION OF THE PREFERRED EMBODIMENTS

Figure 1:
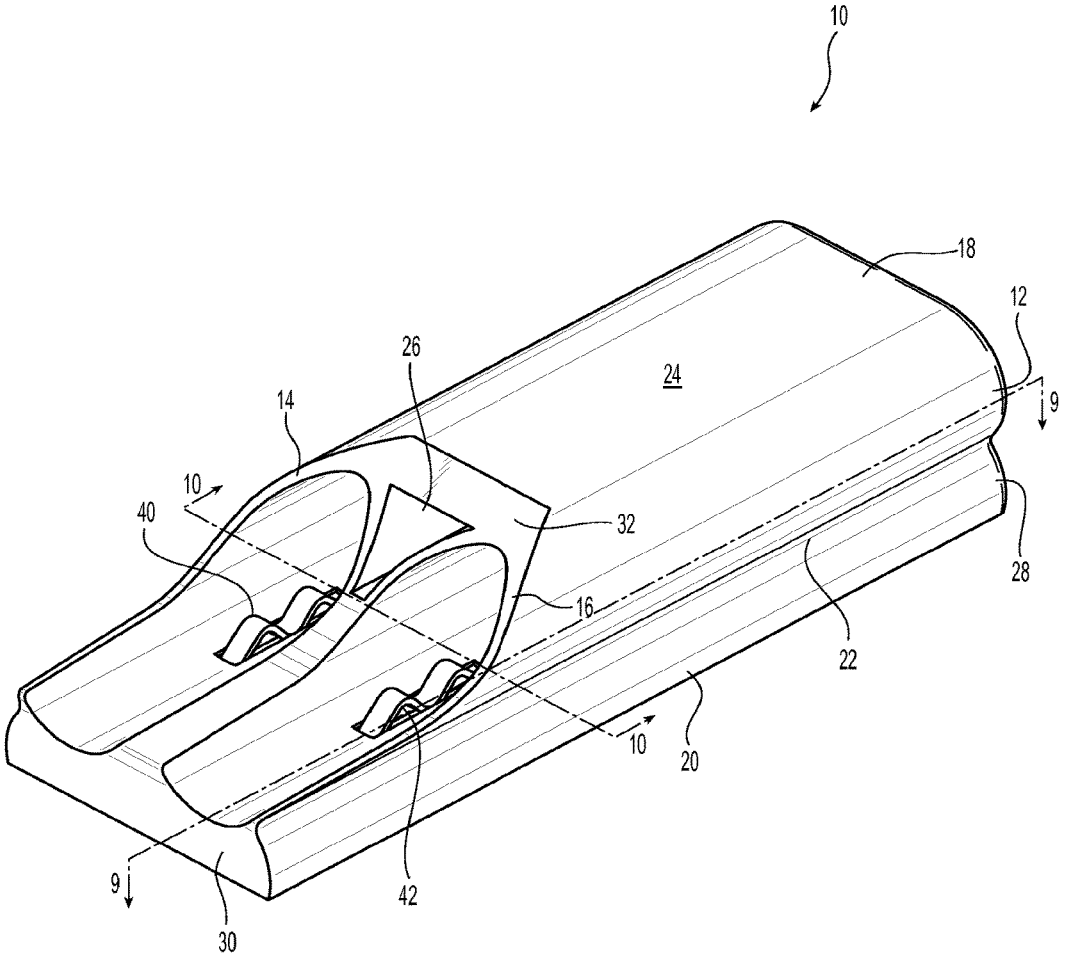
FIG. 1 is a front perspective view of one embodiment of a marker holder and eraser according to one embodiment of the present invention.
Figure 2:
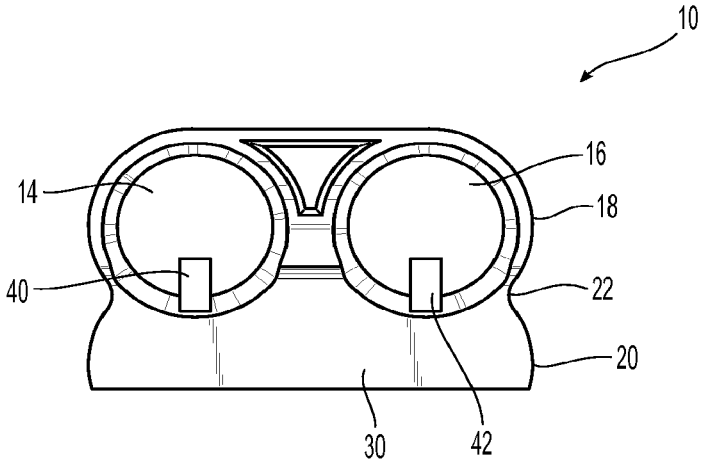
FIG. 2 is a top view of the marker holder and eraser of FIG. 1.
Figure 3:
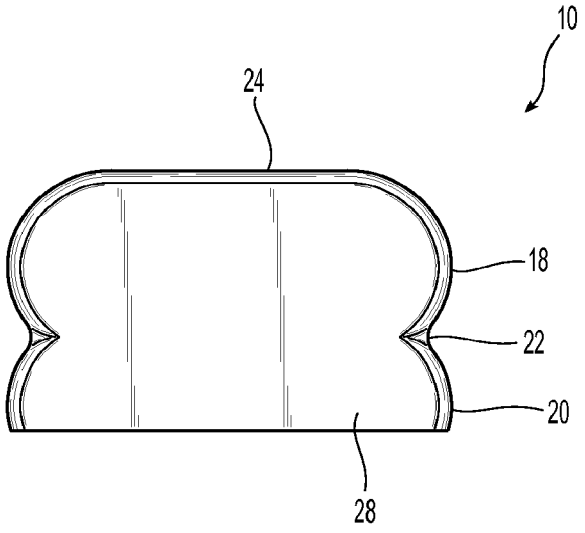
FIG. 3 is a bottom view of the marker holder and eraser of FIG. 1.
Figure 4:
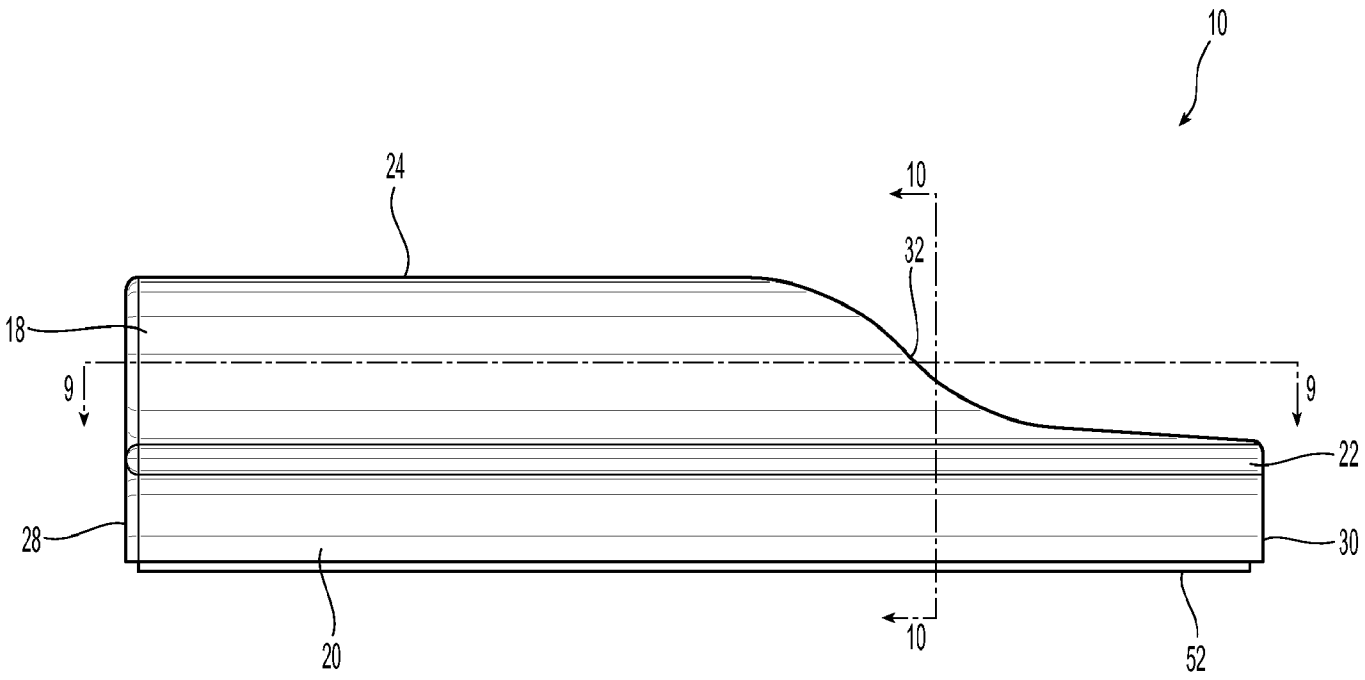
FIG. 4 is a right side view of the marker holder and eraser of FIG. 1.
Figure 5:
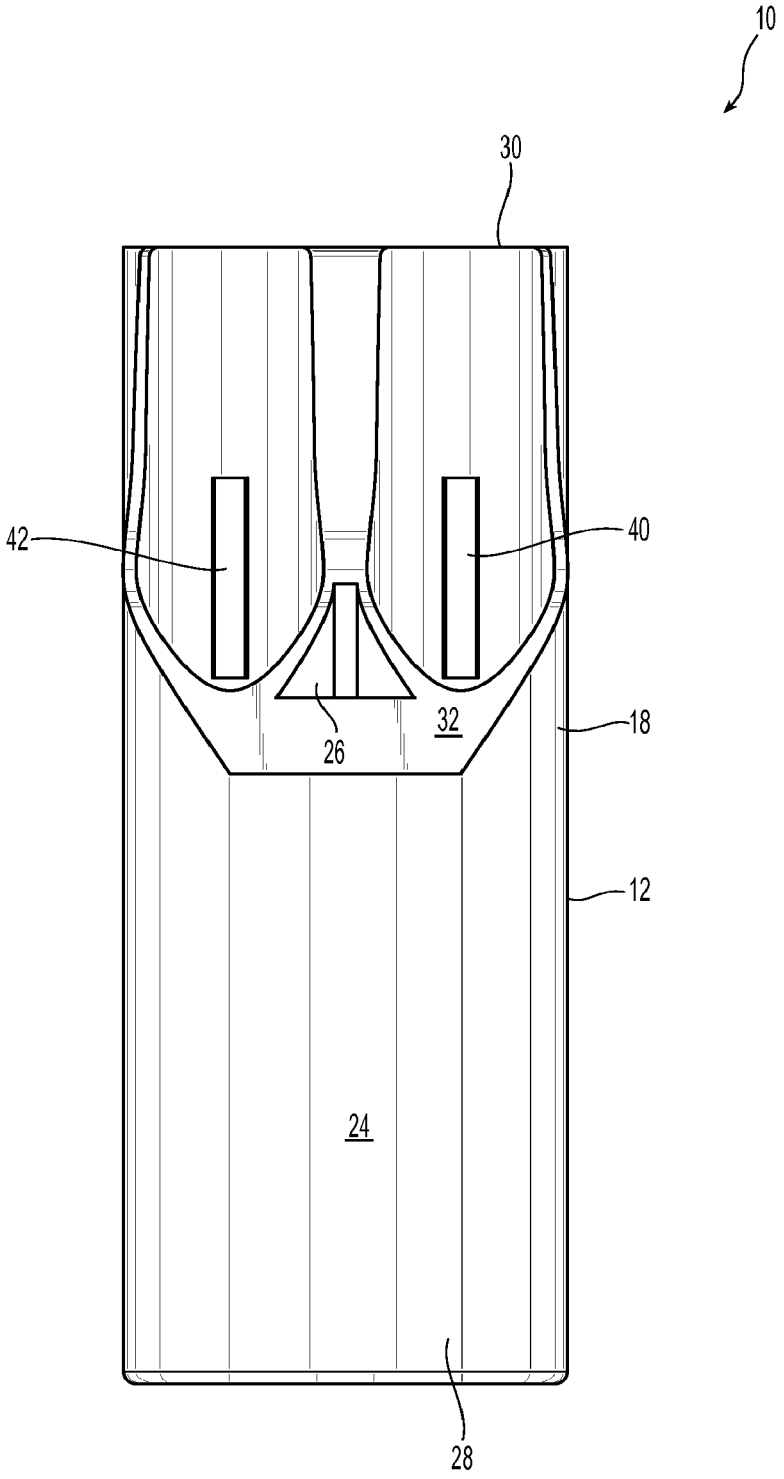
FIG. 5 is a front side view of the marker holder and eraser of FIG. 1.

Reference will now be made in detail to the present preferred embodiment(s) of the invention, examples of which are illustrated in the accompanying drawings. Whenever possible, the same reference numerals will be used throughout the drawings to refer to the same or like parts.

One embodiment of a marker holder and eraser according to the present invention illustrated in the figures is directed to a marker holder and eraser 10 as illustrated in FIGS. 1-10. The marker holder and eraser 10 has a main body 12 with two marker openings 14, 16 to hold a respective dry-erase marker/marker. The main body 12 of marker holder and eraser 10 has an upper portion 18 and a lower portion 20, which are divided by an indentation 22, which also functions as a recess for a user's fingers. Grasping the marker holder and eraser 10 from the front allows the user to put fingers into the indentation 22 and pull the marker holder and eraser 10 off a board by overcoming the magnetic attraction, as described in more detail below. See also FIGS. 2 and 3. The upper portion 18 has an upper surface 24 extending generally across the upper portion 18. An opening 26 can be disposed between the two marker openings 14,16 and the upper surface 24. The opening 26 may be eliminated and/or be sealed either during manufacturing or thereafter. The marker openings 14 and 16, while generally circular in cross-section towards the bottom end 28 of the eraser and marker holder 10, have a more open configuration towards the top end 30. As can be seen in FIG. 1, the top portion of the marker openings 14,16 are semi-circular in cross section. This semi-circular cross section is as a result of the sloped surface 32 that extends from the upper surface 24 towards the top end 30. See also FIGS. 4 and 5. The openness of the marker openings 14,16 at the top end allows the user to easily grasp markers that are inserted into the marker openings 14,16.

Given their length, the maker openings 14,16 are generally cylindrical, with the marker openings 14,16 being reduced in diameter towards the bottom end 28 of the marker holder and eraser 10. See FIG. 9. This allows for a tighter fit of the markers (not shown) in the marker openings 14,16. Also assisting with maintaining any markers within the marker openings 14,16 are resilient projections 40,42, which can exert pressure against a marker inserted into the openings to maintain the markers in the openings 14 and 16, even if the eraser and marker holder 10 is turned upside down. The marker holder and eraser 10 has resilient projection openings 44,46, one of the openings disposed in each of the marker openings 14,16. Extending into the openings 14,16 from a backside thereof and through the resilient projection openings 44,46 are resilient projections 40, 42, which can exert pressure against a marker inserted into the marker openings 14,16 to maintain the markers in the openings 14 and 16, even if the marker holder and eraser 10 is turned upside down.

Figure 6:
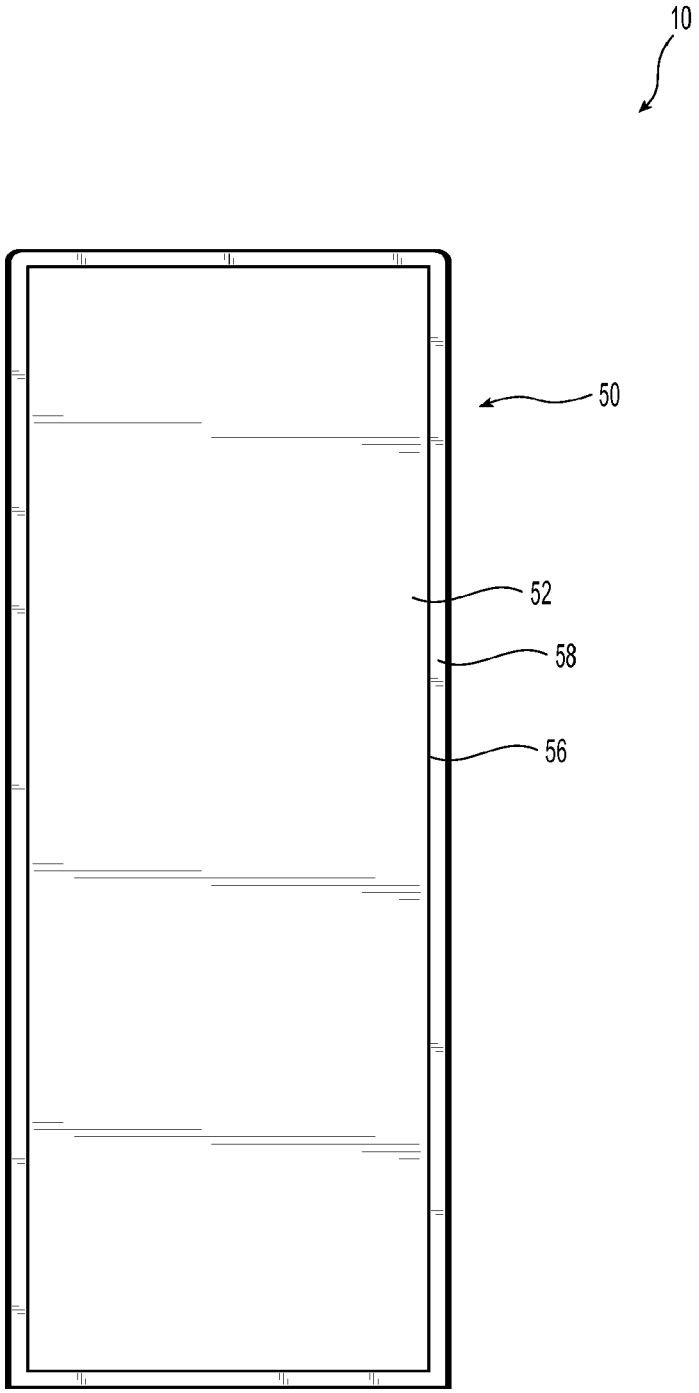
FIG. 6 is a back side view of the marker holder and eraser of FIG. 1.

Turning to the back side 50 of the marker holder and eraser 10 as illustrated in FIG. 6, there is an erasing material 52, which can be felt or any other appropriate material. The erasing material 52 is preferably disposed inside a recess 56 that is formed by an edge 58 of the main body 12. The erasing material 52 protrudes below the lower portion 20 of the marker holder and eraser 10 to allow for erasing of the whiteboard. The erasing material 52 may be adhered to the main body 12 or the other components inside the recess 56.

Figure 7:
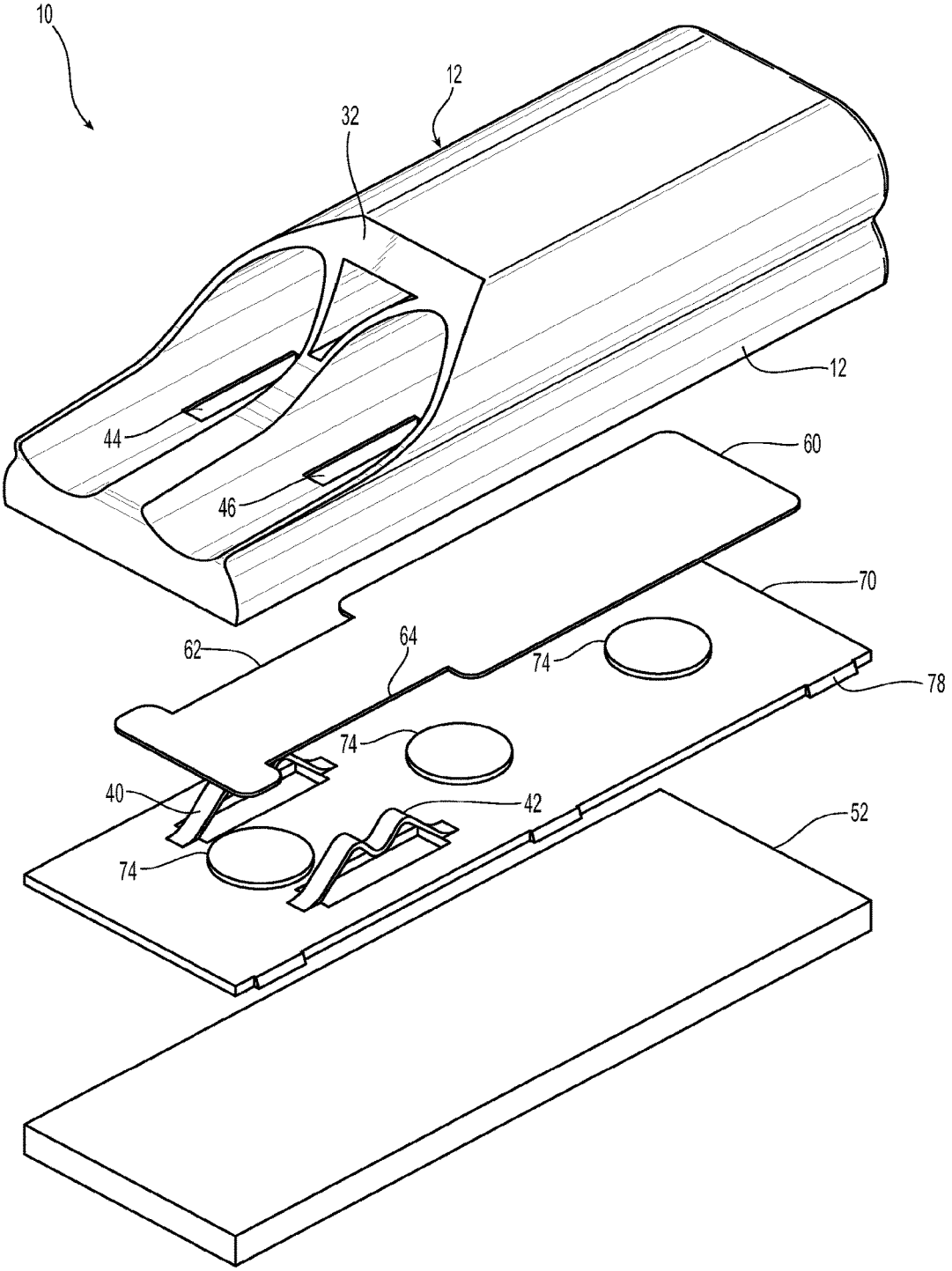
FIG. 7 is an exploded front perspective view of the marker holder and eraser of FIG. 1.
Figure 8:
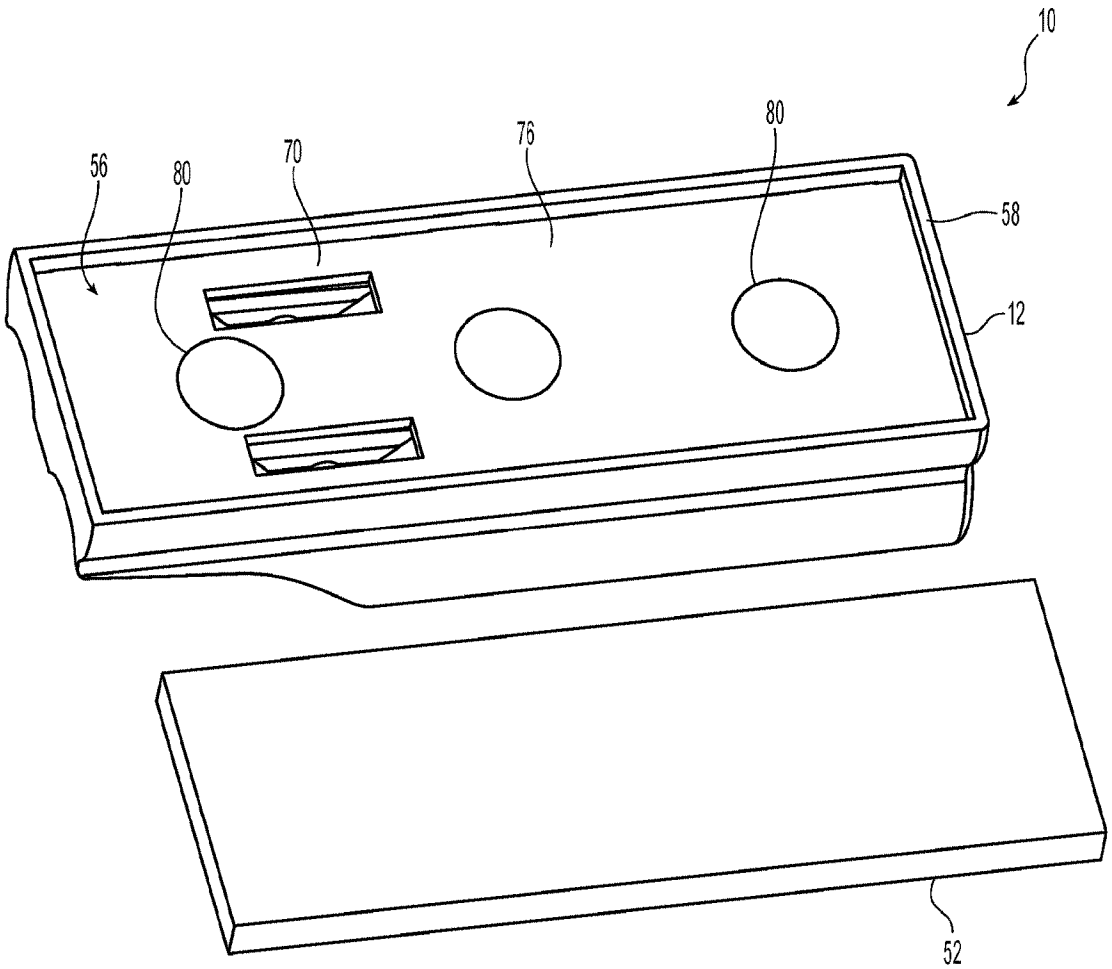
FIG. 8 is a view of the back side of the marker holder and eraser of FIG. 1 with the erasing material removed.
Figure 9:
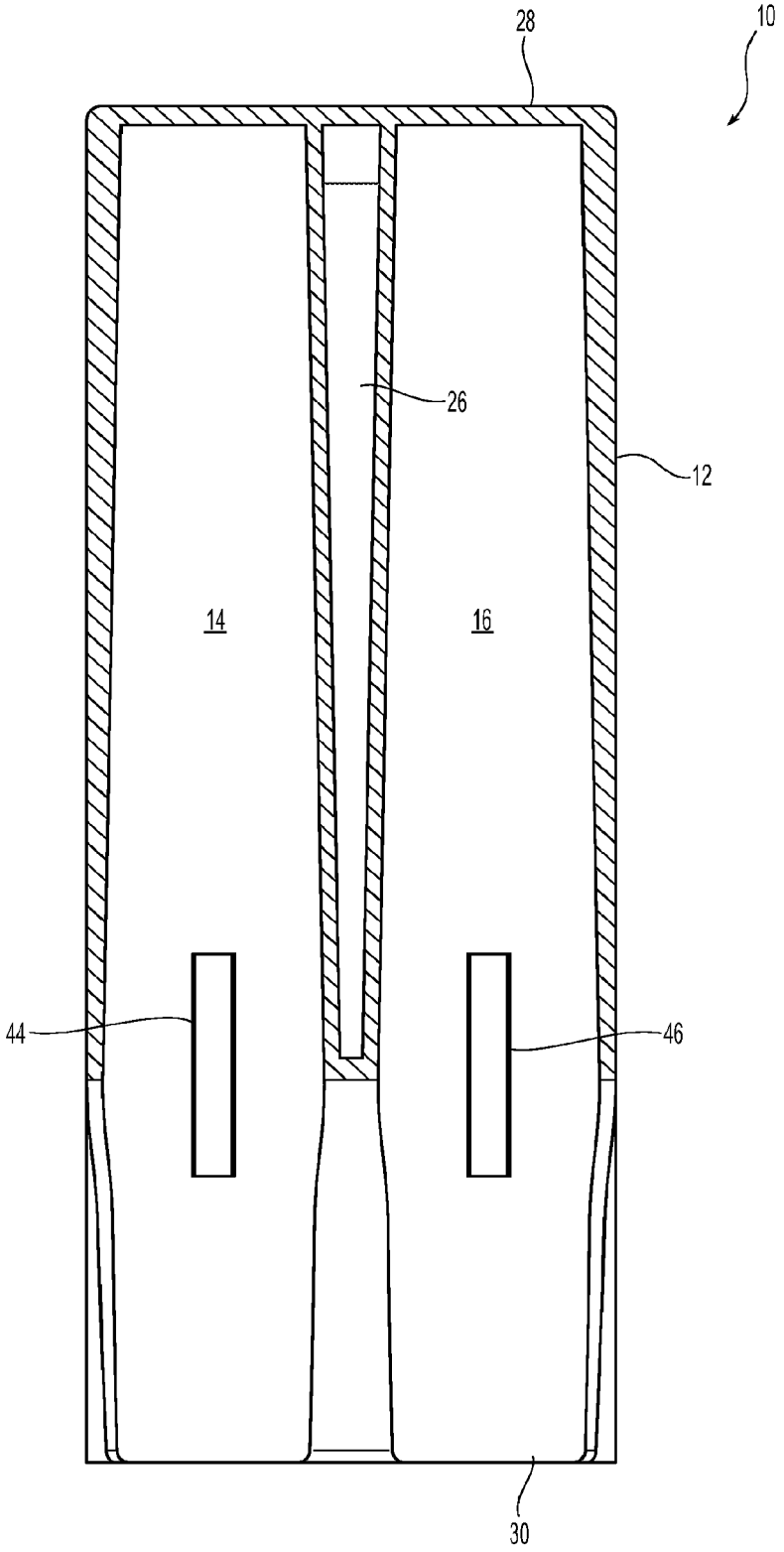
FIG. 9 is a cross section view of the marker holder and eraser along the line 9-9 in FIG. 1.
Figure 10:
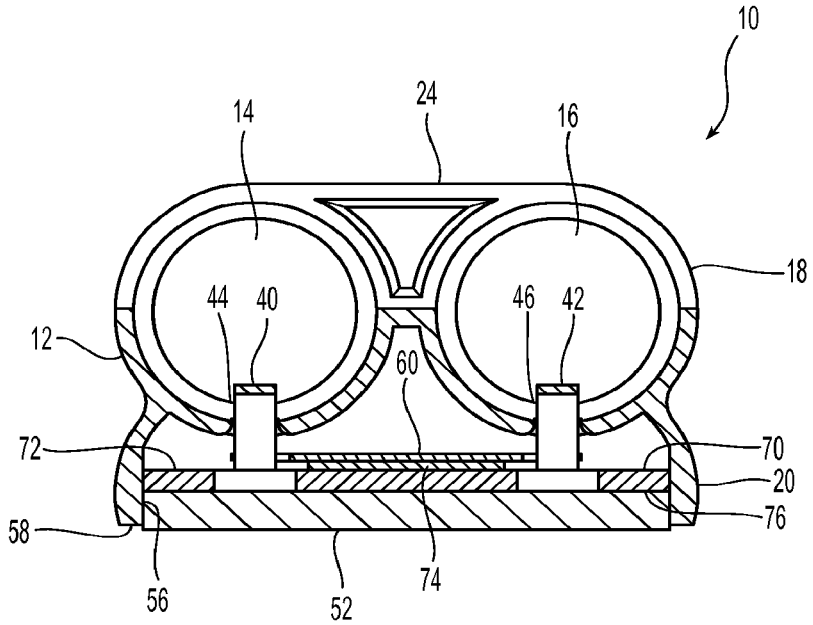
FIG. 10 is a cross section view of the marker holder and eraser along the line 10-10 in FIG. 1.

The back side 50 of the marker holder and eraser 10 has the recess 56 to contain other elements of the marker holder and eraser 10. As illustrated in FIGS. 7, 8, and 10, inserted into the recess 56 are a metal plate 60, a magnet holder 70, magnets 80 (see FIG. 8), and the erasing material 52. The main body 12, as noted above, may have resilient projection openings 44 and 46 to receive resilient projections 40, 42 from the magnet holder 70 therethrough. It is also possible that the resilient projections 40, 42 are formed on the surface in each of the openings 14, 16 of the main body 12, rather than projecting through the resilient projection openings 44 and 46. The metal plate 60 is preferably first disposed into the backside 50 of the main body 12. While the metal plate is first disposed within the recess 56, it could be inserted after the magnet holder 70. The metal plate 60 preferably assists in securing the marker holder and eraser 10 to a metal surface (or the whiteboard with a metal component therein) by evening out the magnetic field from the magnets 80. The magnet holder 70 is used to secure the metal plate 60 within the recess 56 of the main body 12. Magnet holder 70 is preferably made from a plastic material, but may be made of any suitable material. As illustrated, the resilient projections 40, 42 extend upward from the top surface 72 of the holder 70 and pass through resilient projection openings 44 and 46 of the main body 12. The resilient projections 40, 42 extend on either side of the metal plate 60 through cut-outs 62 and 64. The magnet holder 70 also has magnet recesses 74, three of which are illustrated in FIG. 7. The recesses 74 extend upward from the upper surface 72 of the magnet holder 70, so that the underside 76 of the holder 70 is essentially flat with the magnets being flush within each of the magnet recesses 74. The magnet holder 70 also preferably has a plurality of tabs 78 around the periphery thereof to frictionally engage the main body 12 of the marker holder and eraser 10. The recess 56 may also have small indentations or cavities on the inside of the main body 12 to accept the tabs 78 to hold the magnet holder 70 therein. The magnets 80 may be press-fit into the magnet recesses 74 or secured by an adhesive. The erasing material 52 is secured to the underside 76 of the holder 70 by any appropriate means, e.g., adhesive, glue, two-sided tape, etc.

FIG. 8 illustrates the back side 50 of the marker holder and eraser 10 with the eraser material 52 removed therefrom. As can be seen, the three magnets 80 are flush with the underside surface 76 of the holder 70, although it is possible for the magnets 80 to be either recessed into or extend up and out of the recesses 74.

Figure 11:
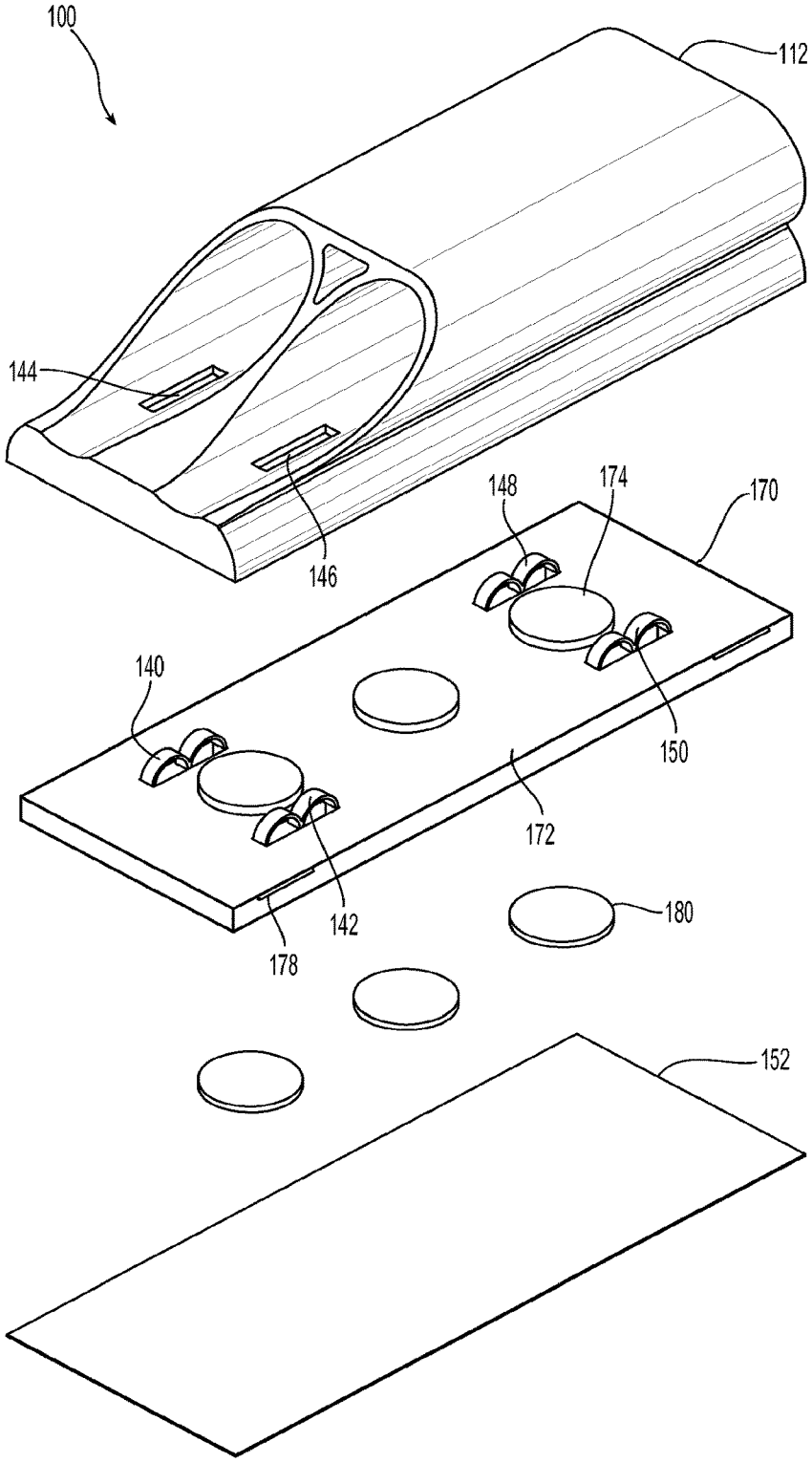
FIG. 11 is an exploded front perspective view of another embodiment of a marker holder and eraser according to the present invention.

FIG. 11 illustrates an alternative embodiment of an eraser and marker holder 100. The eraser and marker holder 100 includes a main body 112, a metal plate can be used but need not be, a magnet holder 170 magnets 180, and the erasing material 152. The main body 112 has resilient projection openings 144 and 146 to receive resilient projections 140, 142 as well as other resilient projection openings not visible to receive receive resilient projections 148, 150 therethrough. The holder 170 is used to secure the metal plate within the main body 112. The magnet holder 170 also has magnet receptacles 174 that extend upward from the upper surface 172 of the magnet holder 170. The magnet holder 170 also preferably has tabs 178 around the periphery thereof to frictionally engage the main body 112 of the marker holder and eraser 100. The magnets 180 may be press-fit into the magnet receptacles 174 or secured by an adhesive. The erasing material 152 is secured to the holder 170 by any appropriate means, e.g., adhesive, glue, two-sided tape, etc.

It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

We claim:

1. A marker holder and eraser comprising:

a main body having a front side and an opposite back side, the front side having at least one marker opening extending along a length thereof to receive a marker therein and the back side having a recess;

a magnet holder disposed within the recess on the back side of the main body;

at least one magnet disposed adjacent the magnet holder;

erasing material disposed within the recess and covering at least a portion of the magnet holder, the erasing material capable of erasing marker ink on a board.

2. The marker holder and eraser according to claim 1, further comprising a metal plate disposed within the recess on the back side of the main body.

3. The marker holder and eraser according to claim 2, wherein the metal plate is inserted into the recess before the magnet holder.

4. The marker holder and eraser according to claim 1, wherein the magnet holder has two resilient projections extending away from a front side of the magnet holder, the main body has two corresponding resilient projection openings, one resilient projection opening being disposed within one of each of the marker openings on the front side of the main body.

5. The marker holder and eraser according to claim 4, wherein the resilient projections engage a marker disposed within the marker openings on the front side.

6. The marker holder and eraser according to claim 1, wherein the marker openings on the front side are cylindrical cavities configured to receive a marker.

7. The marker holder and eraser according to claim 6, wherein the cylindrical cavities have a diameter, the diameter decreasing with increasing depth into the cavities.

8. The marker holder and eraser according to claim 1, wherein the magnet holder has at least two recesses, the at least two recesses each having a magnet therein.

9. The marker holder and eraser according to claim 1, wherein the main body has a top end and a bottom end, the marker openings being circular in cross section at the bottom end and semi-circular at the top end.

10. The marker holder and eraser according to claim 1, wherein the marker openings transition from a semi-circular cross section to a circular cross section thereby forming a sloped surface on the front side of the main body.

11. A marker holder and eraser comprising:

a main body having a front side and an opposite back side, the front side having at least one marker opening extending along a length thereof to receive a marker therein and the back side having a recess;

a metal plate disposed within the recess on the back side of the main body;

at least one magnet disposed adjacent the metal plate;

erasing material disposed within the recess and covering at least a portion of the metal plate, the erasing material capable of erasing marker ink on a board.

12. The marker holder and eraser according to claim 11, wherein the main body has a top end and a bottom end, the marker openings being circular in cross section at the bottom end and semi-circular at the top end.

13. The marker holder and eraser according to claim 11, wherein the marker openings transition from a semi-circular cross section to a circular cross section thereby forming a sloped surface on the front side of the main body.

* * * * *